US006123790A

United States Patent [19]

Lundstrom et al.

[11] Patent Number: 6,123,790

[45] Date of Patent: Sep. 26, 2000

[54] NONAZIDE AMMONIUM NITRATE BASED GAS GENERANT COMPOSITIONS THAT BURN AT AMBIENT PRESSURE

[75] Inventors: Norman H. Lundstrom, Manassas; Robert S. Scheffee, Lorton; Daniel S. Luke, Manassas, all of Va.

[73] Assignee: Atlantic Research Corporation, Gainvesville, Va.

[21] Appl. No.: 09/417,851

[22] Filed: Oct. 14, 1999

Related U.S. Application Data

[62] Division of application No. 09/220,015, Dec. 23, 1998, Pat. No. 6,017,404.

[51] Int. Cl.[7] ..... C06B 31/32; C06B 47/08; C06B 45/10

[52] U.S. Cl. ..... 149/47; 149/36; 149/19.5; 149/19.91; 149/19.7

[58] Field of Search ..... 149/47, 36, 19.5, 149/19.91, 19.7

[56] References Cited

U.S. PATENT DOCUMENTS

| | | | |
|---|---|---|---|
| 3,789,609 | 2/1974 | Hill | 60/219 |
| 3,811,358 | 5/1974 | Morse | 86/20 R |
| 4,128,443 | 12/1978 | Pawlak et al. | 149/71 |
| 4,370,181 | 1/1983 | Lundstrom et al. | 149/2 |
| 4,424,085 | 1/1984 | Fukuma et al. | 149/19.1 |
| 4,658,578 | 4/1987 | Shaw | 60/205 |
| 4,881,994 | 11/1989 | Rudy et al. | 149/109.4 |
| 4,909,549 | 3/1990 | Poole et al. | 280/738 |
| 4,948,439 | 8/1990 | Poole et al. | 149/46 |
| 5,035,757 | 7/1991 | Poole | 149/46 |
| 5,084,118 | 1/1992 | Poole | 149/22 |
| 5,139,588 | 8/1992 | Poole | 149/61 |
| 5,197,758 | 3/1993 | Lund et al. | 280/741 |
| 5,431,103 | 7/1995 | Hock et al. | 102/287 |
| 5,514,230 | 5/1996 | Khandhadia | 149/36 |
| 5,531,941 | 7/1996 | Poole | 264/3.4 |
| 5,641,938 | 6/1997 | Holland et al. | 149/48 |
| 5,682,014 | 10/1997 | Highsmith et al. | 159/36 |
| 5,723,812 | 3/1998 | Berteleau et al. | 149/46 |
| 5,725,699 | 3/1998 | Hinshaw et al. | 149/19.1 |
| 5,726,382 | 3/1998 | Scheffee et al. | 149/19.9 |
| 5,756,929 | 5/1998 | Lundstrom et al. | 149/22 |
| 5,773,754 | 10/1999 | Yamato | 149/36 |
| 5,872,329 | 2/1999 | Burns et al. | 149/36 |
| 5,962,808 | 10/1999 | Lundstrom | 149/19.1 |
| 5,989,367 | 11/1999 | Zeuner et al. | 149/47 |

FOREIGN PATENT DOCUMENTS

| | | |
|---|---|---|
| WO 97/46501 | 12/1997 | WIPO . |
| WO 97/46502 | 12/1997 | WIPO . |
| WO 98/04507 | 2/1998 | WIPO . |
| WO 98/22208 | 5/1998 | WIPO . |

*Primary Examiner*—Charles T. Jordan
*Assistant Examiner*—Aileen J. Baker
*Attorney, Agent, or Firm*—Nixon & Vanderhye P.C.

[57] ABSTRACT

A nonazide gas generant that may be used in an inflation device, such as a vehicle passenger restraint system, comprising a hydrated or anhydrous mixture of nonazide fuel, an oxidizer and a quantity of copper phthalocyanine, otherwise known as Monarch Blue and/or azodicarbonamidine dinitrate. Specifically, the nonazide gas generant composition of the present invention may include phase stabilized ammonium nitrate (PSAN), high bulk density nitroguanidine (HBNQ), one or more nonazide fuels, a quantity of copper phthalocyanine and/or azodicarbonamidine dinitrate and optionally a binder. The gas generant composition of the present invention is capable of self-sustained burning at low or ambient temperatures and pressures, important for use in dual stage "smart" inflator automotive passenger restraint systems, while exhibiting a relatively high gas volume to solid particulate ratio upon combustion at acceptable flame temperatures. The composition also exhibits a tailorable burning rate and properties to preclude catastrophic events during cook off tests.

13 Claims, 3 Drawing Sheets

NONAZIDE AMMONIUM NITRATE BASED GAS GENERANT COMPOSITIONS THAT BURN AT AMBIENT PRESSURE

This is a divisional of application Ser. No. 09/022,015 filed Dec. 23, 1998, now U.S. Pat. No. 6,017,404, the entire content of which is hereby incorporated by reference in this applicaion.

BACKGROUND OF THE INVENTION

1. Field of the Invention

The present invention relates to nonazide gas generating compositions that rapidly generate gases upon combustion for use in inflating occupant safety restraints in motor vehicles. Specifically, the invention relates to thermally stable nonazide gas generants capable of self-sustained burning at ambient pressures and temperatures, and exhibiting a relatively high gas volume to solid particulate ratio upon combustion at acceptable flame temperatures, as well as exhibiting a tailorable burning rate and a higher melting point than prior art formulations.

2. Background Art

Nonazide gas generant compositions have been used in recent years to replace azide based gas generant compositions. There are a number of advantages of nonazide gas generant compositions over azide gas generants, which are well documented in the patent literature, for example, U.S. Pat. Nos. 4,909,549; 4,948,439; 5,197,758; 5,531,941; 5,545,272; 5,756,929, and WO 98/04507, the content of which are incorporated by reference. Nonazide gas generant compositions are advantageous for providing a relatively nontoxic gas which is rapidly generated upon combustion. One of the disadvantages of nonazide gas generant compositions is the amount of solid combustion products, as well as the physical characteristics of the solid combustion products, formed during combustion.

As well as fuel constituents, gas generant compositions may contain other ingredients such as oxidizers, to provide the required oxygen for rapid combustion and to reduce the quantity of toxic gases generated, and catalysts to promote the conversion of toxic oxides of carbon and nitrogen to innocuous gases. The solids produced as a result of combustion must be filtered and otherwise kept away from contact with the occupants of the vehicle. Therefore, gas generant compositions may also contain slag-forming constituents to cause the solid liquid products formed during and immediately after combustion to agglomerate into filterable clinker-like particulates. Other optional additives such as burning rate enhancers, ballistic modifiers and ignition aids may also be used to control the ignitability and combustion properties of the gas generant composition.

For the oxidizer constituent, the use of phase stabilized ammonium nitrate (PSAN) is desirable because it results in formation of substantially all gaseous reaction products, discounting, of course, the minimal solids resulting from the use of the phase stabilizer. The majority of gas generant compositions comprised of ammonium nitrate, however, have burn rates less than desirable for use in inflators for airbags. To be useful for passenger restraint inflator applications, gas generant compositions generally require a burn rate of at least 0.40 inch/second (ips) at 1,000 pound per square inch pressure (psi). Gas generant compositions with burn rates of less than 0.40 ips at 1,000 psi do not ignite reliably and often result in "no-fires" when tested at −40° F. in the inflator.

However, in addition to producing abundant gases and minimal solids, gas generants for automotive applications should be thermally stable when aged for 400 hours or more at 107° C. The compositions must also retain structural integrity when cycled between −40° C. and 107° C. The melting point is also important because an increased melting point will give a particular gas generant an increased margin of safety. A low melting point composition has an inherently decreased safety factor. Accordingly, many nonazide propellants based on ammonium nitrate cannot meet requirements for automotive applications.

U.S. Pat. No. 5,545,272 to Poole discloses the use of gas generant compositions consisting of nitroguanidine (NQ) at a weight percent of 35%–55%, and phase stabilized ammonium nitrate (PSAN) at a weight percent of 45%–65%. NQ is a generally desirable fuel because it generates abundant non-toxic gases when formulated with the PSAN to provide the proper oxygen to fuel balance. Poole notes, however, that the use of PSAN or pure ammonium nitrate (AN) is a problem since many gas generant compositions containing this oxidizer have unacceptably low melting points and are thermally unstable. There is also no mention of high bulk density nitroguanidine (HBNQ). Although Poole combines NQ and PSAN in the percentages given to provide allegedly thermally stable gas generant compositions, Poole reports burn rates of only 0.32–0.34 ips at 1,000 psi. Burn rates below 0.40 ips at 1,000 psi are generally not as desirable for use within an inflator due to the rapid reaction times required for properly inflating an airbag. In addition, there is no inference of the capabilities for self-sustained combustion at ambient pressure and temperature for these formulations.

U.S. Pat. No. 5,531,941 to Poole teaches the use of PSAN, and two or more nonazide fuels provided in specified groups. In view of the recognition by Poole of the above noted low burn rates, Poole combines PSAN with a fuel component containing a majority of triaminoguanidine nitrate (TAGN), and, if desired, one or more additional fuels. The addition of TAGN increases the burn rate of ammonium nitrate mixtures. TAGN, however, is a sensitive explosive that poses safety concerns in processing and handling, and is classified as "Forbidden" by the Department of Transportation, which complicates raw material requirements.

The gas generant compositions described in Poole et al., U.S. Pat. Nos. 4,909,549 and 4,948,439, use tetrazole or triazole compounds in combination with metal oxides and oxidizer compounds (alkali metal, alkaline earth metal, and pure ammonium nitrates or perchlorates) resulting in a relatively unstable generant that decomposes at low temperatures. Both patents teach the use of $BKNO_3$ as an ignition aid.

Lund et al., U.S. Pat. No. 5,197,758, describes gas generating compositions comprising a nonazide fuel that is a transition metal complex of an aminoazole, and, in particular, copper and zinc complexes of 5-aminotetrazole and 3-amino-1,2,4-triazole that are useful for inflating air bags in automotive restraint system, but generate excess solids.

U.S. Pat. No. 5,756,929 to Lundstrom et al. relates to nonazide gas generating compositions that contain fuels selected from guanidine, azole, and other high nitrogen aliphatic, aromatic, and/or heterocyclic compounds. There is no mention of specially processed high bulk density nitroguanidine (HBNQ). Other materials may also be added to the compositions for processing, such as ignition aids, ballistic enhancers, particulate reducers and scavengers. However, the use of ammonium nitrate is not specifically described in the Lundstrom et al. patent.

In addition, Khandhadia et al., WO 98/04507 describes nonazide gas generant compositions incorporating a combination of NQ, one or more nonazide high-nitrogen fuels, and PSAN or similar nonmetallic oxidizer. Again, there is no mention of the use of specially processed high bulk density nitroguanidine (HBNQ). The gas generant compositions are disclosed to result in a good yield of gaseous production per mass unit of gas generant upon combustion and a reduced yield of solid combustion products, with acceptable burn rates, thermal stability, and ballistic properties. However, these compositions do not exhibit self-sustained combustion at ambient pressure and temperature.

Based on the above, the need remains for a nonazide gas generant composition that can be used in inflation devices and that is capable of self-sustained burning at ambient pressures and temperatures, while exhibiting a relatively high gas volume to solid particulate ratio upon combustion at acceptable flame temperatures, as well as exhibiting a tailorable burning rate and a higher melting point than prior art formulations.

SUMMARY OF THE INVENTION

An object of the present invention is to overcome the deficiencies of the prior art and to provide a nonazide gas generant composition that exhibits a relative high gas volume to solid particulate ratio upon combustion at acceptable flame temperatures.

Another object of the present invention is to provide a nonazide gas generant composition that is capable of self-sustained burning at ambient pressure.

Yet another object of the present invention is to provide a nonazide gas generant composition that possesses a tailorable burning rate and a higher melting point than prior art gas generant compositions.

Still another object of the present invention is to provide a nonazide gas generant composition that exhibits a higher melting point onset to provide a more stable gas generant composition.

Another object of the present invention is to provide a nonazide gas generant composition that provides a dual stage combustion capability for use in "smart" soft or hard (child or adult) inflation environments in which the secondary generant material remaining after soft combustion can be self depleted via self sustained combustion at ambient pressure shortly after the inflation event.

The aforementioned objects are achieved by a nonazide gas generant that may be used in an inflation device, such as a vehicle passenger restraint system, comprising a hydrated or anhydrous mixture of nonazide fuel, an oxidizer and a low pressure combustion enhancer comprised of a quantity of copper phthalocyanine, commonly referred to as Monarch Blue. Azodicarbonamidine dinitrate may also be included, as a combustion enhancer, with or without Monarch Blue with a combination of the above components. Additional additives are also useful for providing the desired self sustained combustion at ambient pressure. Specifically, the nonazide gas generant composition of the present invention may include phase stabilized ammonium nitrate (PSAN), high bulk density nitroguanidine (HBNQ), one or more additional nonazide fuels, and a quantity of copper phthalocyanine or azodicarbonamidine dinitrate. In addition, the gas generant composition of the present invention may also include a binder.

The nonazide fuels may include guanidines; tetrazoles, such as 5,5' bitetrazole, diammonium 5,5'-bitetrazole, diguanidinium 5,5'-azotetrazolate (GZT), and nitrotetrazoles, such as 5-nitrotetrazole; triazoles, such as nitroaminotriazole, nitrotriazoles, and 3-nitro-1,2,4 triazole-5-one (NTO); and salts of tetrazoles and triazoles.

Optional inert additives such as clay, alumina, or silica may be used as a binder, slag former, coolant or processing aid. Optional ignition aids including nonazide propellants may also be used in place of conventional ignition aids such as $BKNO_3$.

DETAILED DESCRIPTION OF THE PREFERRED EMBODIMENT

Figure 1:
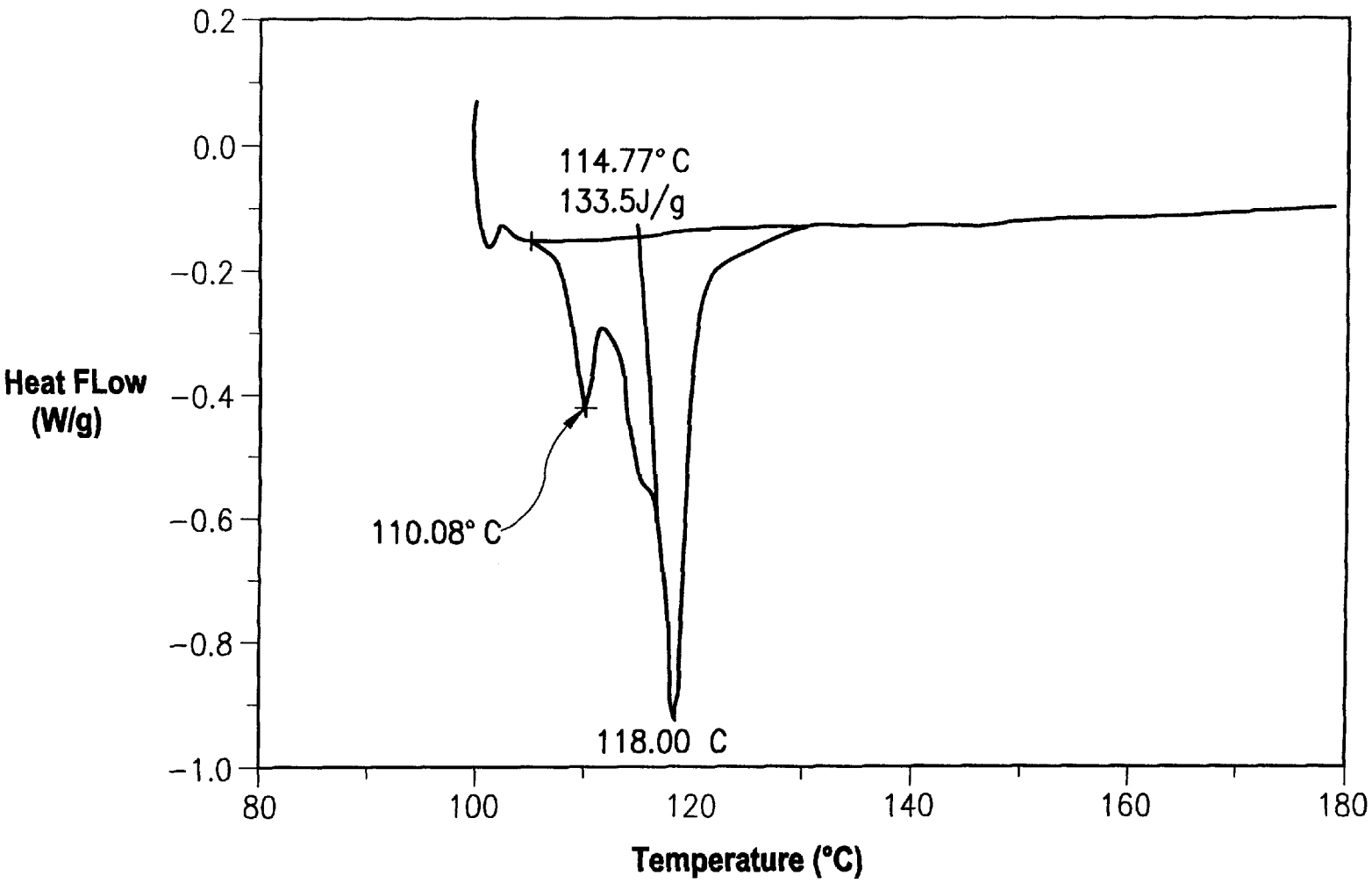
FIG. 1 is a differential scanning calorimetry thermogram of a conventional phase stabilized ammonium nitrate gas generant.

The present invention relates to a nonazide gas generant useful in an inflation device, such as a vehicle passenger restraint system, comprising a hydrated or anhydrous mixture of nonazide fuel, an oxidizer and a low pressure combustion enhancer comprising a quantity of copper phthalocyanine, otherwise known as Monarch Blue, or azodicarbonamidine dinitrate or mixtures thereof. The gas generant composition of the present invention is capable of self-sustained burning at low or ambient temperatures and pressures, while exhibiting a relatively high gas volume to solid particulate ratio upon combustion at acceptable flame temperatures. The composition also exhibits a tailorable burning rate and greater thermal stability with a resulting higher melting point than prior art formulations. As a result, because of the unique capability to burn at ambient pressure, the gas generant composition can be effectively used in a dual stage inflation device for soft and hard combustion where unconsumed secondary gas generant material remaining after a soft inflation is burned at ambient pressure after the main combustion event to consume the remaining gas generant material left in the inflator. The removal of the remaining unused portion of the gas generant material is desirable so that pyrotechnic material does not remain in the vehicle.

The particular type of dual stage inflation device is a smart device, an example of which might include the use of electronic sensors which are provided to detect the amount of mass occupying a vehicle seat in front of an air bag. These sensors tell the inflation device how much gas generant composition to burn depending upon the mass of the occupant. For instance, depending upon whether a child or an adult are sitting in front of an air bag device, the sensors will indicate to the inflation device whether to initiate a soft or hard inflation. If a soft inflation event occurs, the gas generant composition of the present invention permits the self sustained combustion at ambient pressure of any remaining gas generant in the inflator device.

The higher temperature melting point exhibited by the present gas generant composition also permits the use of conventional, more thermally stable types of auto-ignition pellet compositions commonly used with non-ammonium nitrate gas generants for meeting the requirements specified by the Department of Transportation (DOT) for passing "All Up" inflator bonfire and cook off tests. This, in turn, allows the use of lower weight inflation devices since the resulting composition is more thermally stable, burns at lower pressures, and is less catastrophic in bonfire tests.

Specifically, the gas generant composition of the present invention comprises phase stabilized ammonium nitrate (PSAN), high bulk density nitroguanidine (HBNQ), one or more nonazide high-nitrogen fuels, a quantity of copper phthalocyanine and/or azodicarbonamidine dinitrate to act as an ambient pressure combustion enhancer and optionally a binder for providing improved temperature and cycling stability. One or more high-nitrogen fuels may include tetrazoles, such as salts or derivatives of 1H-tetrazole, 5,5'-bitetrazole, 5, 5'-azobistetrazole; triazoles, such as nitroaminotriazole, nitrotriazole, aminotriazole, and 3-nitro-1,2,4 triazole-5-one (NTO); guanidine salts or derivatives, such as nitroaminoguanidine, and guanidine nitrate; caged nitramine compounds, an example of which is hexanitrohexaazaisowurtzitane (HNIW), commonly referred to as CL-20, and azodicarbonamidine dinitrate.

More specifically, salts of tetrazoles include in particular, the monoammonium salt of 5,5'-bis-1H-tetrazole (BHT-INH3) and the diammonium salt of 5,5'-bis-1H-tetrazole (BHT-2NH3).

In accordance with the present invention, a preferred gas generant composition which burns completely at ambient pressures results from the mixture of gas generant constituents including high bulk density nitroguanidine (HBNQ), comprising 1%–30% by weight of the gas generant composition, one or more nonazide high nitrogen fuels selected from guanidines, formamidines, tetrazoles, triazoles, caged nitramines, salts of tetrazole and/or triazole, salts of guanidine, and salts of formamidine and derivatives of azobisformamidines, comprising 0–40% by weight of the gas generant composition, PSAN, comprising 40%–85% by weight of the gas generant composition, and 1–2% by weight of the gas generant composition of copper phthalocyanine (Monarch Blue).

In the percentages given, an even more preferred embodiment results from the mixture of gas generant constituents consisting essentially of HBNQ, PSAN, amine salt(s) of 5,5'-bis-lH-tetrazole and copper phthalocyanine. In the percentages given, a most preferred composition results from the mixture of gas generant constituents consisting essentially of HBNQ, PSAN, diammonium salt of 5,5'-bis-1H-tetrazole (DABTZ), and copper phthalocyanine. When combined, the fuel component consisting of HBNQ and one or more high nitrogen fuels as described herein comprises 15%–60% by weight of the gas generant composition.

The gas generant composition may also include ceric oxide, $CeO_2$, or the combination of ceric oxide and super fine iron oxide. Ceric Oxide or the combination of ceric oxide and super fine iron oxide may be present in the range of 0–2.0% by weight of the gas generant composition.

The gas generant composition of the present invention may also include a conventional binder to improve the structural integrity of the resulting gas generant. For example, a suitable binder is polyalkylene carbonate (Q-PAC) produced by PAC Polymer, Inc. and may be present in an amount from 0–5%. Alternatively, the binder may be polyvinyl alcohol or cellulose acetate butyrate. The structural integrity provided by using such a binder in the gas generant composition of the present invention prevents fracturing of the resulting gas generant pellets under high ignition pressure and normal vibration that occurs during the life of a vehicle.

In accordance with procedures well known in the art, the foregoing nonazide fuels, and/or nonmetal salts of tetrazole or triazole, are blended with an oxidizer such as PSAN and HBNQ. High bulk density nitroguanidine (HBNQ) has a number of advantages over conventional nitroguanidine for use in gas generant formulations. Conventional standard low bulk density nitroguanidine crystallizes from hot water as long, thin, flexible needles that are tough and difficult to pulverize. Because of the low bulk density of the product resulting from the conventional process used to prepare nitroguanidine, uniformity within powder blends during powder blending operations of gas generant ingredients is very difficult to maintain. In addition, feeding operations of the powder blends of gas generant ingredient mixtures containing conventional nitroguanidine into the multi-stage rotary presses used for molding the powder into the final pelletized form are very difficult and result in poorly formed, non-uniform pellets with poor crush strength, poor dimensional integrity and non-uniform ballistic characteristics. Further, the critical diameter of low bulk density conventional nitroguanidine is significantly lower than that of high bulk density nitroguanidine, which raises a number of hazard sensitivity concerns.

In contrast to the above described problems associated with conventional nitroguanidine, high bulk density nitroguanidine (HBNQ) is a free flowing material readily available from commercial sources which is a trouble free alternative to the problems associated with the use of conventional low bulk density nitroguanidine in powder mixture blending, feeding, and pressing operations required for the manufacture of gas generant pellets. By utilizing high bulk density nitroguanidine (HBNQ), gas generant pellets are produced that are uniform in composition, ballistic properties, gas output and structural integrity.

The manner and order in which the components of the gas generant compositions of the present invention are combined and compounded is not critical so long as high bulk density nitroguanidine (HBNQ) is selected and used in combination with the other ingredients of the composition for providing the desired particle size distribution. This results in a readily blended, uniform mixture that is free flowing and provides consistency with regard to ballistic properties and structural integrity when molded into pellets. Because the high bulk density nitroguanidine (HBNQ) has a bulk density which is much greater than conventional nitroguandine (0.8 to 1.1 g/cm$^3$ vs. 0.2 to 0.4 g/cm$^3$) and the high bulk density nitroguanidine (HBNQ) has a much wider particle size distribution than conventional nitroguandine (5 to 500 $\mu$m vs. 3 to 6 $\mu$m), blending operations allow the other ingredients of the gas generant to fill the interstices of the HBNQ particle fractions, resulting in a more uniform, easily blended, free flowing mixture prior to pelletization.

The compounding is performed by one skilled in the art, under proper safety procedures for the preparation of energetic materials, and under conditions that will not cause undue hazards in processing nor decomposition of the components employed. For example, the materials may be wet blended, or dry blended and attrited in a ball mill or a paint shaker and then pelletized by compression molding. The materials may also be ground separately or together in a fluid energy mill, vibroenergy mill, or micropulverizer and then blended or further blended in a V-blender prior to compaction.

Compositions having components more sensitive to friction, impact, and electrostatic discharge should be wet ground separately followed by drying. The resulting fine powder of each of the components may then be wet blended by tumbling with ceramic cylinders in a ball mill jar, for example, and then dried. Less sensitive components may be dry ground and dry blended at the same time.

Phase stabilized ammonium nitrate (PSAN) may be prepared by a variety of methodologies, an example of which is taught in U.S. Pat. No. 5,531,941 entitled, "Process For Preparing Azide-free Gas Generant Composition". Other nonmetal inorganic oxidizers such as ammonium perchlorate, or oxidizers that produce minimal solids when combined and combusted with the fuels listed above, may also be used provided any scavengers required are also included in the formulation. The ratio of oxidizer to fuel is preferably adjusted so that the amount of molecular oxygen allowed in the equilibrium exhaust gases is less than 3% by weight, and more preferably between 2% and −10% by weight. The oxidizer comprises 20%–85% by weight of the gas generant composition.

The majority of the gas generant constituents of the present invention are commercially available. For example, the amine salts of tetrazoles may be purchased from Tokyo Kasei Kogyo Company Limited, Japan. High bulk density nitroguanidine (HBNQ) may be purchased from Nigu Chemie, and, the components used to synthesize PSAN, as described herein, may be purchased from Fisher Scientific, Inc. or Aldrich Chemical Company.

Triazole salts may be synthesized by techniques, such as those described in U.S. Pat. No. 4,236,014 to Lee et al.; in "New Explosives: Nitrotriazoles Synthesis and Explosive Properties", by H. . Licht, H. Ritter, and B. Wanders, Postfach 1260, D579574 Weil am Rhein; and in "Synthesis of Nitro Derivatives of Triazoles", by Ou Yuxiang, Chen Boren, Li Jiarong, Dong Shuan, Li iianjun, and Jia Huiping, Heterocycles, Vol. 38, No. 7, pps. 1651–1664, 1994. The teachings of these references are herein incorporated by reference. Other compounds in accordance with the present invention may be obtained as taught in the references incorporated herein, or from other sources well known to those skilled in the art.

An optional burn rate modifier, from 0–10% by weight in the gas generant composition, is selected from a group including an alkali metal, an alkaline earth or a transition metal salt of tetrazoles or triazoles; an alkali metal or alkaline earth nitrate or nitrite; dicyandiamide, and alkali and alkaline earth metal salts of dicyandiamide; alkali and alkaline earth borohydrides; or mixtures thereof. An optional combination slag former and coolant, in a range of 0% to 10% by weight, may include clay, silica, glass, and alumina, or mixtures thereof. When combining the optional additives described, or others known to those skilled in the art, care should be taken to tailor the additions with respect to acceptable thermal stability, burn rates, and ballistic properties.

In accordance with the present invention, the combination of HBNQ, PSAN, oe or more nonazide high-nitrogen fuels, and copper phthalocyanine or azodicarbonamidine dinitrate, discussed in greater detail below, and optionally a binder yields beneficial gaseous products equal to or greater than 90% of the total product mass and solid products equal to or less than 10% of the total product mass.

Such combinations are high in nitrogen content and low in carbon content, providing burn rates up to greater than 0.40 ips at 1,000 psi, with a minimal generation of carbon monoxide. The amine salts of tetrazoles and triazoles disclosed in the invention are not explosive and can be transported safely. Furthermore, the gas generant compositions of the present invention have burn rates that meet and surpass performance criteria for use within a passenger restraint system, thereby reducing performance variability.

An unexpected benefit of the gas generants of the present invention containing copper phthalocyanine is their thermal stability. The thermal stability of the gas generants is unexpected based on the poor stability of other fuels, in particular various triazoles, tetrazoles and guanidine derivatives when combined with PSAN. This thermal stability is evidenced by an increased melting point over prior art compositions. Specifically, an additional unexpected, but necessary, benefit of the compositions of the present invention for achieving the objectives for use in a "smart" dual level inflator, is the capability of self-sustained burning at ambient pressure and temperature. In contrast to other thermally stable compositions consisting of NQ and PSAN, the compositions of the present invention ignite readily and without delay and exhibit self-sustained ignition at ambient pressure and temperature. This permits the self-removal of any remaining unburned propellant after ignition in a gas generating device, particularly in a dual stage "smart" inflation device, where either a soft or hard inflation scheme is selected, depending on the size and weight of the occupant.

Furthermore, the burning rate can be varied by varying the ratio of copper phthalocyanine (Monarch Blue) or azodicarbonamidine dinitrate, ceric oxide, and/or super fine iron oxide, which provides more flexibility for use of the composition of the present invention in gas generating environments.

The present invention is illustrated by the following examples. All compositions are given in percent by weight.

EXAMPLES

Several base mixtures of ammonium nitrate (AN), potassium nitrate (KN), high bulk density nitroguanidine (HBNQ), and diammonium bitetrazole (DABTZ) were prepared. The ammonium nitrate was phase stabilized by co-precipitating with KN. The mixture was dry-blended and compression molded into pellets. These mixtures, with the exception of using high bulk density nitroguanidine (HBNQ), for improved process ability and more uniform ballistic control, are similar to those disclosed in WO 98/04507, discussed above, and are used herein as comparative examples to compare their characteristics with mixtures made in accordance with the present invention.

Specifically, several mixtures were also made in accordance with the present invention to include the above-noted components, as well as copper phthalocyanine (Monarch Blue). Some mixtures were also formed to include ceric oxide in addition to the copper phthalocyanine.

| Composition | | |
|---|---|---|
| | Mixture 1A | Mixture 1A-MB |
| PSAN (10% KN) | 70.28 | 68.87 |
| DABTZ | 16.72 | 16.38 |
| HBNQ | 13.00 | 12.74 |
| Monarch Blue | 00.00 | 2.00 |
| | Mixture 2A | Mixture 2A-MB |
| PSAN (10% KN) | 67.17 | 65.83 |
| DABTZ | 19.83 | 19.43 |
| HBNQ | 13.00 | 12.74 |
| Monarch Blue | 00.00 | 2.00 |
| | Mixture 3A | Mixture 3A-MB |
| PSAN (10% KN) | 65.23 | 63.93 |
| DABTZ | 19.77 | 19.37 |

-continued

| Composition | | |
|---|---|---|
| HBNQ | 15.00 | 14.70 |
| Monarch Blue | 00.00 | 2.00 |
| | Mixture 4A | Mixture 4A-MB |
| PSAN (10% KN) | 68.08 | 66.72 |
| DABTZ | 20.92 | 20.50 |
| HBNQ | 11.00 | 10.78 |
| Monarch Blue | 00.00 | 2.00 |
| | Mixture 5A | Mixture 5A-MB |
| PSAN (10% KN) | 64.05 | 62.77 |
| DABTZ | 22.95 | 22.49 |
| HBNQ | 13.00 | 12.74 |
| Monarch Blue | 00.00 | 2.00 |

The existence of self-sustained open air burning was subjectively determined by impinging a flame from a propane torch on the edge of ½"×⅝" pellets and broken pellet fragments from each of the above noted mixtures formed by dry blend and wet blend. The flame was impinged on the fragments until ignition was observed, followed by removal of the flame. The results of these tests revealed that the mixtures that did not include the Monarch Blue exhibited no or only marginal self-sustained combustion, while the mixtures that did include the Monarch Blue, both dry blended and wet blended, exhibited self-sustained combustion.

More specifically, low pressure pellet burning in a strand burner was conducted on Mixtures 3A and 3A-MB at 50 psi, on Mixtures 4A and 4A-MB at 75 psi, and Mixtures 2A and 2A-MB at 100 psi. In each case, the mixtures that did not include Monarch Blue exhibited No Burn. However, Mixture 3A-MB was 97% burned, Mixture 4A-MB was 100% burned (0.046 ips) and Mixture 2A-MB was 100% burned (0.061 ips).

The effects of aging on compressive strengths on the above compositions were also determined by aging pellets of these compositions at 107° C. for 400 hours and cycling these pellets from −40° C. to 107° C. back and forth for 200 cycles. The results of these aging tests are provided as follows:

| Results | | |
|---|---|---|
| | Mixture 1A | Mixture 1A-MB |
| Initial | 6250 | 6432 |
| 107° C. aging (400 hrs.) | 5432 | 5029 |
| Cycling Data (200 cycles) | 2115 | 2510 |
| | Mixture 2A | Mixture 2A-MB |
| Initial | 6191 | 6013 |
| 107° C. aging (400 hrs.) | 6316 | 4970 |
| Cycling Data (200 cycles) | 2420 | 2775 |
| | Mixture 3A | Mixture 3A-MB |
| Initial | 6460 | 6344 |
| 107° C. aging (400 hrs.) | 5772 | 5102 |
| Cycling Data (200 cycles) | 2409 | 2647 |
| | Mixture 4A | Mixture 4A-MB |
| Initial | 6293 | 6266 |

-continued

| Results | | |
|---|---|---|
| 107° C. aging (400 hrs.) | 6236 | 5257 |
| Cycling Data (200 cycles) | 2908 | 3112 |
| | Mixture 5A | Mixture 5A-MB |
| Initial | 6328 | 6257 |
| 107° C. aging (400 hrs.) | 5508 | 4622 |
| Cycling Data (200 cycles) | 2840 | 2807 |

Typically, when additional components are added to ammonium nitrate gas generant compositions, aging properties of the resulting composition are degraded. However, in addition to the remarkable effects of copper phthalocyanine (Monarch Blue), for providing combustion at ambient pressure, the aging properties of the resulting compositions of the present invention are not degraded.

The burn rates of the compositions were determined by measuring the time required to burn a cylindrical pellet of known length at constant pressure. The unexpected results provided in detail below illustrate that the composition of the present invention including copper phthalocyanine (Monarch Blue) exhibits just as desirable burning rates as gas generant compositions similar to the prior art which do not include copper phthalocyanine (Monarch Blue). The really important advantage of the gas generant compositions of the present invention containing copper phthalocyanine (Monarch Blue), over those of the prior art, however, is the capability for self-sustained combustion at ambient pressure for use in dual stage "smart" inflators and comparable aging and cycling characteristics, as noted above, as compared with those exhibited by prior art gas generant compositions that did not include copper phthalocyanine (Monarch Blue).

| Results<br>Dry Blend | Mixture 1A | Mixture 1A-MB |
|---|---|---|
| Rb @ 1,000 psi | — | 0.41 |
| Rb @ 2,000 psi | — | 0.72 |
| Rb @ 3,000 psi | — | 0.96 |
| Rb @ 4,000 psi | — | 1.02 |
| Dry Blend | Mixture 2A | Mixture 2A-MB |
| Rb @ 1,000 psi | 0.42 | 0.42 |
| Rb @ 2,000 psi | 0.78 | 0.82 |
| Rb @ 3,000 psi | 1.02 | 1.01 |
| Rb @ 4,000 psi | 1.10 | 1.08 |
| Dry Blend | Mixture 3A | Mixture 3A-MB |
| Rb @ 1,000 psi | 0.40 | 0.40 |
| Rb @ 2,000 psi | 0.81 | 0.86 |
| Rb @ 3,000 psi | 1.05 | — |
| Rb @ 4,000 psi | 1.13 | 1.15 |
| Dry Blend | Mixture 4A | Mixture 4A-MB |
| Rb @ 1,000 psi | 0.44 | 0.40 |
| Rb @ 2,000 psi | 0.87 | 0.88 |
| Rb @ 3,000 psi | 1.08 | 1.05 |
| Rb @ 4,000 psi | — | 1.11 |
| Dry Blend | Mixture 5A | Mixture 5A-MB |
| Rb @ 1,000 psi | 0.41 | 0.35 |
| Rb @ 2,000 psi | 0.89 | 0.81 |
| Rb @ 3,000 psi | — | 1.15 |

-continued

| Results | | |
|---|---|---|
| Rb @ 4,000 psi | 1.23 | — |
| Wet Blend | Mixture 2A-MB | Mixture 4A-MB |
| Rb @ 1,000 psi | 0.40 | 0.41 |
| Rb @ 2,000 psi | 0.81 | 0.85 |
| Rb @ 3,000 psi | 0.97 | 1.03 |

Again, the addition of the copper phthalocyanine (Monarch Blue) did not affect the burning rates at elevated pressures compared to prior gas generant compositions that did not include copper phthalocyanine (Monarch Blue), but did result in the very important ability to combust at ambient pressure.

Additional mixtures were also formed similar to Mixtures 2A-MB and 4A-MB, but which included 2% super fine iron oxide designated below as Mixture 6A-P and Mixture 7A-P, and 2% Monarch Blue/super fine iron oxide (50/50 Wet), designated below as Mixture 8A-MBP and Mixture 9A-MBP. Burning rates of compacted pellets made of these mixtures are summarized below.

| Results | | |
|---|---|---|
| Wet Blend | Mixture 6A-P | Mixture 7A-P |
| Rb @ 1,000 psi | 0.27 | 0.29 |
| Rb @ 2,000 psi | 0.57 | 0.62 |
| Rb @ 3,000 psi | 0.81 | 0.80 |
| Wet Blend | Mixture 8A-PMB | Mixture 9A-PMB |
| Rb @ 1,000 psi | 0.34 | 0.37 |
| Rb @ 2,000 psi | 0.67 | 0.69 |
| Rb @ 3,000 psi | 0.82 | 0.81 |

As can be seen above, these additional mixtures including super fine iron oxide depressed the burning rate at lower pressures which allow a greater capability for tailorability of ballistic properties, if desired.

Several additional mixtures of ammonium nitrate (AN), potassium nitrate (KN), diammonium bitetrazole (DABTZ), high bulk density nitroguanidine (HBNQ), polyalkylene carbonate (QPAC-40) binder, ceric oxide and copper phthalocyanine (Monarch Blue) were prepared. The ammonium nitrate was phase stabilized by co-precipitating with 10% KN. The mixture was dry-blended and pressed into gas generant pellets. Hazard properties determined for these compositions indicated a high degree of insensitivity with regard to impact, friction, and electrostatic sensitivity.

TABLE 1

| Gas Generant Compositions of Present Invention | | | | |
|---|---|---|---|---|
| Mixture 10A-MB | 1 | 2 | 3 | 4 |
| PSAN (10% KN) | 73.31 | 71.29 | 69.27 | 71.03 |
| DABTZ | 11.69 | 13.71 | 15.73 | 14.97 |
| HBNQ | 11.00 | 11.00 | 11.00 | 11.00 |
| QPAC-40 | 2.00 | 2.00 | 2.00 | 2.00 |
| $CeO_2$ | 0 | 1.00 | 2.00 | 0.50 |
| Monarch Blue | 2.00 | 1.00 | 0 | .50 |

TABLE 2

| Hazards Data | | | | |
|---|---|---|---|---|
| 10-AMB | 1 | 2 | 3 | 4 |
| Impact, Eo | 10 neg @ 300 kgcm | 10 neg @ 300 kgcm | 10 neg @ 300 kgcm | 10 neg @ 300 kgcm |
| Friction, ABL | 10 negative @ 1800 psi and 90° drop angle | | | |
| ESD | 10 negatives @ 5 KV @ 6 Joules | | | |

Figure 2:
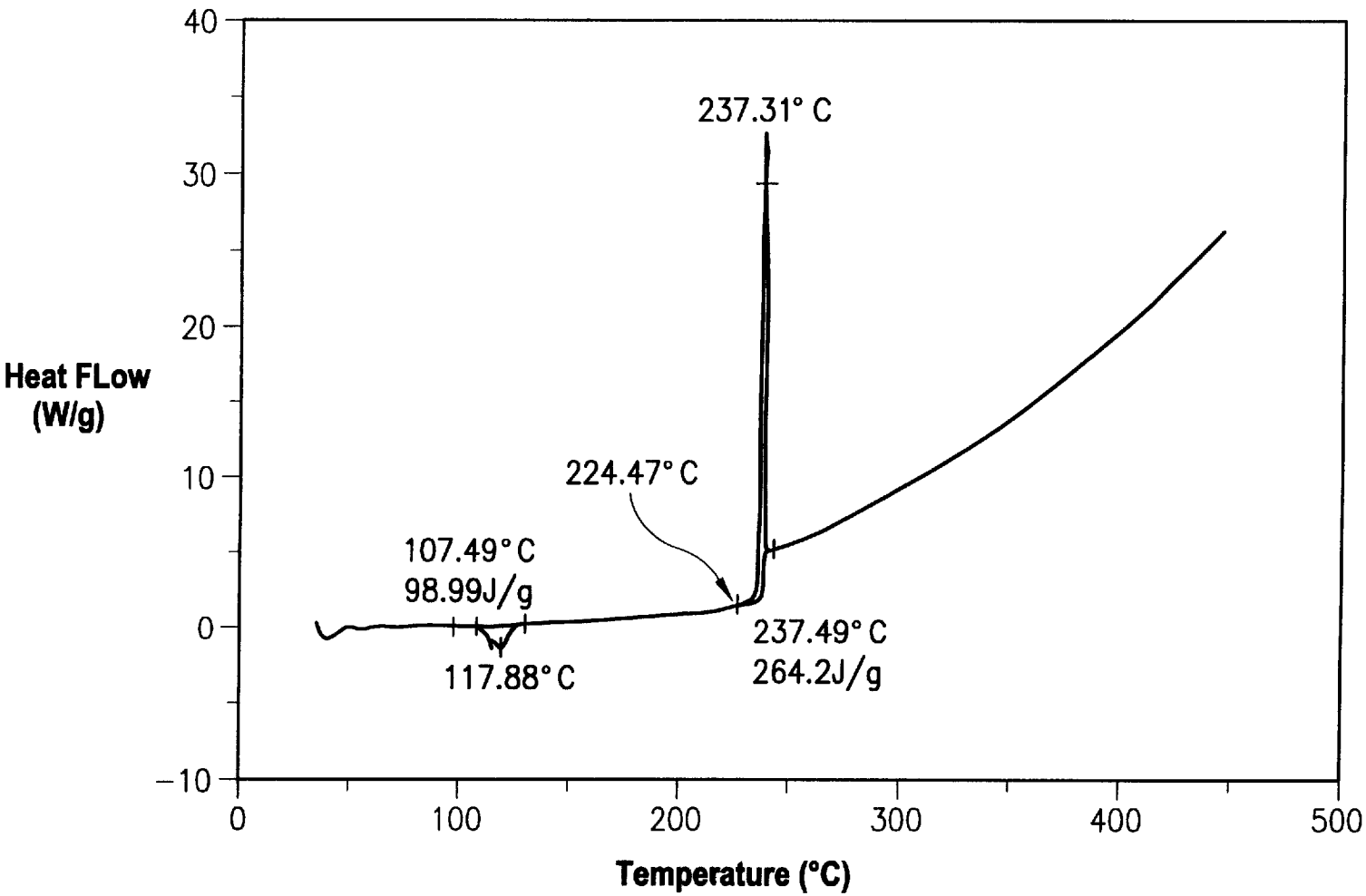
FIG. 2 is a differential scanning calorimetry thermogram of another conventional phase stabilized ammonium nitrate gas generant.

In addition, FIG. 1 is a differential scanning calorimetry thermogram of a conventional gas generant composition including phase stabilized ammonium nitrate. The graph indicates that the melting point onset of this prior art composition begins at approximately 110° C., with major melting occurring at 118° C. FIG. 2 is a differential scanning calorimetry thermogram of another prior art phase stabilized ammonium nitrate composition, which indicates the melting point onset of this prior art composition begins to occur at approximately 107° C., with major melting occurring over the range of 107° C. to 117° C.

Figure 3:
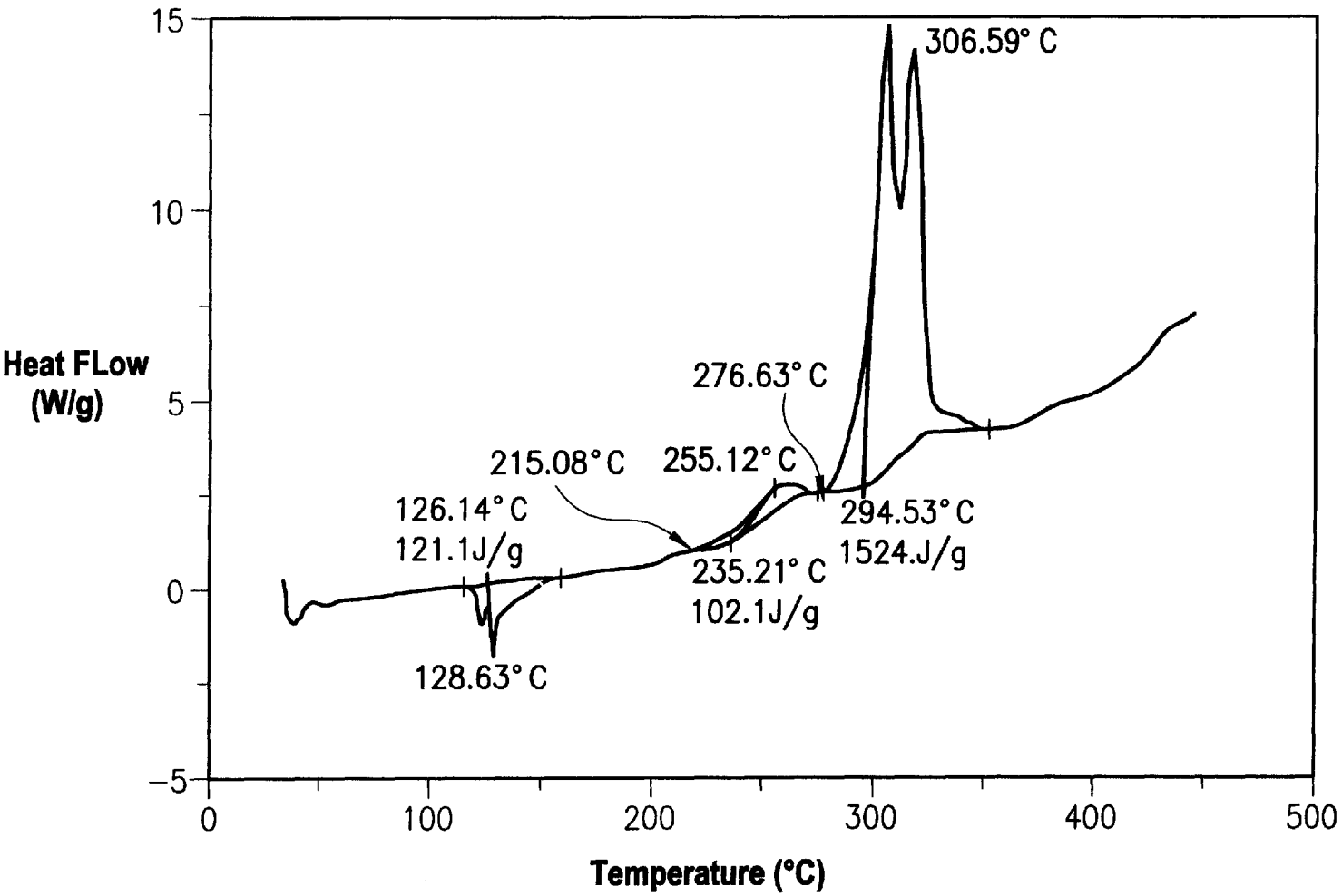
FIG. 3 is a differential scanning calorimetry thermogram of an embodiment of the present invention.

On the other hand, FIG. 3 is a differential scanning calorimetry thermogram of above-noted example, Mixture 1OA-MB(1) of the present invention, which illustrates a melting point onset of this composition of the present invention beginning to occur at approximately 126° C., with major melting occurring at about 128° C.

Fisher Johns Melting Points were also conducted on the compositions provided in FIGS. 1–3, resulting in the following results, 120° C., 121° C. and 134° C., respectively. Again, the present invention began melting at a significantly higher temperature than prior art formulations.

By exhibiting a higher melting point, the gas generant compositions of the present invention allow their use with more conventional auto-ignition pellets designed to ignite at higher temperatures than those required for prior art AN gas generants. This results in an increased margin of safety when AN based gas generants are selected for use in inflators for smart airbag systems. This, in turn, allows the use of lower weight inflation devices since the resulting composition is more thermally stable and less catastrophic during cook off.

This is a very important finding because in a Department of Transportation bonfire test or cook off test the gas generant in an inflator must cook off mildly without a catastrophic event. The fact that the PSAN based gas generant of the present invention melts over a temperature range of 10–15° C. higher than that of the prior art compositions enables the gas generant of the present invention to be in a solid state when deliberately ignited by a low ignition temperature auto-ignition pellet incorporated into the inflator. Because the gas generant of the present invention retains its solid state prior to the intentional ignition of the generant by the auto-ignition pellet, significantly less surface area of the gas generant is available for burning at the time of cook off.

In other words, in the present invention, the total burning surface area of the gas generant during a cook off event is its solid geometric area which assures controlled and predictable burning and results in a mild, non-catastrophic failure of the inflator. In contrast, when a prior art PSAN gas generant melts and liquefies during heating, its burning surface area is unpredictable often leading to uncontrolled burning which results in catastrophic failure of the inflator at the time of the intended auto-ignition event.

Table 3 also provides the equilibrium thermochemistry for Mixture 6A-MB(1), the results of which are provided below.

TABLE 3

Equilibrium Thermochemistry of Mixture 10A-MB(1)

Case 1 Iteration 0
Atomic Composition of Ingredients, GM-ATOMS/GFW

| Ingredient | H | C | N | O | K | CU | Mass Grams |
|---|---|---|---|---|---|---|---|
| NH4NO3 | 4.000 | .000 | 2.000 | 3.000 | .000 | .000 | 65.978 |
| KNO3 | .000 | .000 | 1.000 | 3.000 | 1.000 | .000 | 7.331 |
| DABTZ | 8.000 | 2.000 | 10.000 | .000 | .000 | .000 | 11.691 |
| HBNQ | 4.000 | 1.000 | 4.000 | 2.000 | .000 | .000 | 11.000 |
| QPAC4O | 6.000 | 4.000 | .000 | 3.000 | .000 | .000 | 2.000 |
| COPHTH | 16.000 | 32.000 | 8.000 | .000 | .000 | 1.000 | 2.000 |

| | ISP LBF*S | IVAC LBF*S | Pressure PSIA | Temp-DEG K. | Enthalpy CAL | Entropy CAL | HT. Cap CAL | MOLS Gas MOLES |
|---|---|---|---|---|---|---|---|---|
| | LBM | LBM | | | 100GM | K*100GM | K*100GM | 100GM |
| CHAMBER | | | 4000.000 | 2259.3 | −81702 | 228.483 | 46.485 | 4.1129 |

MOLES PER 100 GRAMS OF PROPELLANT AT EQUILIBRIUM CONDITIONS

| | CHAMBER | | CHAMBER | | CHAMBER |
|---|---|---|---|---|---|
| (KOH)2 | 9.75E−05 | C | 5.78E−16 | C2H2 | 2.66E−14 |
| C2N2 | 1.60E−15 | CH | 3.73E−15 | CH2 | 3.94E−13 |
| CH3 | 6.61E−11 | CH4 | 8.11E−10 | CN | 1.96E−11 |
| CO | 7.46E−02 | CO2 | 3.56E−01 | CU | 5.40E−04 |
| CU2 | 4.78E−06 | CUH | 2.69E−04 | CUO | 1.95E−06 |
| H | 2.72E−04 | H2 | 8.10E−02 | H2O | 2.10E+00 |
| HCN | 1.12E−07 | HCO | 2.79E−07 | HNO | 2,28E−07 |
| HNO2 | 2.04E−08 | HNO3 | 6.57E−13 | K | 1.46E−03 |
| K2 | 2.64E−07 | KH | 1.80E−05 | KO | 8.56E−06 |
| KOH | 7.08E−02 | N | 3.61E−09 | N2 | 1.43E+00 |
| NH | 7.40E−09 | NH2 | 2.74E−07 | NH3 | 2.61E−05 |
| NO | 2.32E−04 | NO2 | 2.32E−08 | O | 2.48E−06 |
| O2 | 2.70E−05 | OH | 1.09E−03 | C$ | 1.00E−25 |
| CU$ | 1.00E−25 | CU(OH)2$ | 1.00E−25 | CU2O$ | 1.00E−25 |
| CUO$ | 1.00E−25 | K2CO3$ | 1.00E−25 | CU* | 2.65E−03 |
| CU2O | 1.00E−25 | K2CO3* | 1.00E−25 | KOH* | 1.00E−25 |
| TOTAL MOLES: | 4.11551 | MOLES GAS: | 4.11286 | MOLES $,*: | .00265 |

As provided above, the ingredients include $NH_4NO_3$ and KNO3 (PSAN); DABTZ; HBNQ; QPAC40; and copper phthalocyanine.

In addition to the use of copper phtalocyanine, the gas generant composition of the present invention may also include azodicarbonamidine dinitrate (AZODN), $C_2H_8N_8O_6$ The azodicarbonamidine dinitrate may be formed as the reaction product of the potassium permanganate oxidation of nitric acid and aminoguanidine salts, such as aminoguanidine bicarbonate, aminoguanidine sulfate, aminoguanidine nitrate, or combinations thereof. Preferably, the aminoguanidine salt is aminoguanidine bicarbonate. The use of the bicarbonate salt with nitric acid provides a cost effective means of producing the azodicarbonamidine dinitrate of the present invention.

TABLE 4

Influence of AZODN on Combustion of PSAN Propellants at Ambient and Elevated Pressure w/o Binders

| Mixture | 11A | 12A-AZODN | 13A-AZODN |
|---|---|---|---|
| PSAN* | 65.23 | 65.23 | 65.23 |
| DABTZ | 19.77 | 17.77 | 14.77 |
| HBNQ | 15.00 | 15.00 | 15.00 |
| AZODN | — | 2.00 | 5.00 |
| Burn to completion | No | No | Yes |

TABLE 4-continued

Influence of AZODN on Combustion of PSAN Propellants at Ambient and Elevated Pressure w/o Binders

| Mixture | 11A | 12A-AZODN | 13A-AZODN |
|---|---|---|---|
| at ambient pressure Standard Burner Tests: | | | |
| Burn to Completion at 50 psi | No | No | Yes |
| Burning Rate at 1000 psi, ips | 0.40 | 0.37 | 0.36 |

*Ammonium nitrate phase stabilized with potassium perchlorate

TABLE 5

Comparison of Low Pressure Combustion and Burning Rate Enhancement of PSAN/PVA Propellants with and w/o AZODN

| Mixture | 14A | 15A-AZODN |
|---|---|---|
| PSAN* | 64.00 | 51.20 |
| GN | 31.00 | 24.80 |
| AZODN | — | 20.00 |
| PVA BINDER | 5.00 | 4.00 |
| Burn to completion | No | Yes |

TABLE 5-continued

Comparison of Low Pressure Combustion and Burning Rate Enhancement of PSAN/PVA Propellants with and w/o AZODN

| Mixture | 14A | 15A-AZODN |
|---|---|---|
| at ambient pressure | | |
| Strand Burner Tests: | | |
| Bum to completion at 50 psi | No | Yes |
| Burning Rate at 1000 psi ips | 0.24 | 0.30 |

*Ammonium nitrate phase stabilized with potassium perchlorate

TABLE 6

Comparison of Low Pressure Combustion and Burning Rate Enhancement of PSAN/PC Propellants with and w/o AZODN

| Mixture | 16A | 17A-AZODN |
|---|---|---|
| PSAN* | 68.08 | 35.73 |
| HBNQ | 9.50 | — |
| DABTZ | 19.42 | — |
| AZODN | — | 61.27 |
| QPAC-40 PC Binder | 3.00 | 3.00 |
| Burn to completion at ambient pressure | No | Yes |
| Strand Burner Tests: | | |
| Bum to completion at 50 psi | No | Yes |
| Burning Rate at 1000 psi ips | 0.28 | 0.46 |

*Ammonium nitrate phase stabilized with potassium perchlorate.

As noted above with respect to the use of copper phthalocyanine (Monarch Blue) with phase-stabilized ammonium nitrate, the use of AZODN combined with phase-stabilized ammonium nitrate also provides the ability for combustion at ambient pressure. Although lower concentrations of AZODN do not provide a burning rate at 1000 psi greater than or equal to 0.40 ips, a concentration of 5.0% by weight still provides combustion at ambient pressure with a burning rate of 0.37 ips.

In order to obtain burning rates above 0.40 ips at 1000 psi, the propellants can contain greater concentrations of AZODN. As the AZODN concentration increases, the ability to burn at ambient pressure is more easily obtained and burning rates above 0.40 ips at 1000 psi can be achieved, as provided above in Mixture 17A-AZODN. As a result, AZODN is not only a low pressure combustion additive, but is also a burning rate modifier that allows the formulation of propellants which meet the desired 0.40 requirement at 1,000 psi.

Additional materials can also be added to the gas generant composition including AZODN such as other bum rate modifiers, slag formers, and coolants which are the same as those described in detail above with respect to the first embodiment of the present invention including copper phthalocyanine. In addition, the nonazide fuels disclosed above with respect to the first embodiment of the present invention including copper phthalocyanine are similarly useful in the gas generant composition of the present invention including AZODN.

While the foregoing examples illustrate and describe the use of the present invention, they are not intended to limit the invention as disclosed in certain preferred embodiments herein. Therefore, variations and modifications commensurate with the above teachings and the skill and/or knowledge of the relevant art, are within the scope of the present invention.

We claim:

1. A gas generant composition for a gas generator of a vehicle passenger restraint system, said gas generant composition comprising a hydrated or anhydrous mixture of:

(i) high bulk density nitroguanidine;

(ii) one or more nonazide fuels;

(iii) an oxidizer which includes a phase stabilized ammonium nitrate; and (iv) an amount of copper phthalocyanine sufficient to sustain combustion of the gas generant composition at ambient pressure of about 100 psi or less.

2. The gas generant composition of claim 1, wherein said copper phthalocyanine is present in the mixture in an amount of 2% by weight.

3. The gas generant composition of claim 2 wherein:

said high bulk density nitroguanidine in combination with said nonazide fuels comprise up to 60% by weight of said mixture;

said oxidizer comprises 20%–85% by weight of said mixture.

4. The gas generant composition of claim 3 wherein said non-azide fuels are selected from a group consisting of guanidines, formamidines, tetrazoles, triazoles, caged nitramines, salts of tetrazole, salts of triazole, salts of guanidine, salts of formamidine, and derivatives of azobisformamidines.

5. The gas generant composition of claim 4 wherein said nonazide fuels are selected from a group consisting of 5,5' bitetrazole, diammonium bitetrazole, diguanidinium 5,5'azotetrazolate, nitrotetrazoles, 5-nitrotetrazole, triazoles, nitroaminotriazole, nitrotriazoles, and 3-nitro-1,2,4 triazole-5-one.

6. The gas generant composition of claim 4 wherein said nonazide fuel comprises monoammonium salt of 5,5'-bis-1H-tetrazole.

7. The gas generant composition of claim 4 wherein said nonazide fuel comprises diammonium salt of 5,5'-bis-1H-tetrazole.

8. The gas generant composition of claim 4 further comprising a burn rate modifier selected from a group comprising alkali, alkaline earth, and transitional metal salts of tetrazoles and triazoles, triaminoguanidine nitrate, alkali and alkaline earth metal nitrates and nitrites, dicyandiamide, alkali and alkaline earth metal salts of dicyanamide, alkali and alkaline earth borohydrides, and mixtures thereof.

9. The gas generant composition of claim 5 further comprising a combination slag former and coolant selected from a group comprising clay, silica, glass, alumina, and mixtures thereof.

10. The gas generant composition of claim 4 wherein said nonazide fuels are selected from the group consisting of 1-, 3-, and 5- substituted nonmetal salts of triazoles and 1- and 5- substituted nonmetal salts of tetrazoles, said salts consisting of nonmetallic cationic and anionic components; and said salts substituted with hydrogen or a nitrogen-containing compound.

11. The gas generant composition of claim 2 comprising 2–5% by weight polyalkylene carbonate binder.

12. The gas generant composition of claim 2 comprising 2–5% by weight polyvinyl alcohol binder.

13. The gas generant composition of claim 2 comprising 2–5% by weight cellulose acetate butyrate binder.

* * * * *